United States Patent [19]

Hoskins

[11] Patent Number: 4,926,890

[45] Date of Patent: May 22, 1990

[54] COMPOSITION AND METHOD FOR ENHANCING FINGERNAILS

[76] Inventor: Margaret E. Hoskins, 2230 Homestead Ct., #211, Los Altos, Calif. 94022

[21] Appl. No.: 168,855

[22] Filed: Mar. 16, 1988

[51] Int. Cl.[5] ..... A45D 29/00

[52] U.S. Cl. ..... 132/73; 132/200; 424/61

[58] Field of Search ..... 132/73, 200; 424/61

[56] References Cited

U.S. PATENT DOCUMENTS

| | | | |
|---|---|---|---|
| 3,483,289 | 12/1969 | Michaelson | 424/61 |
| 3,552,401 | 1/1971 | Michaelson | 132/73 |
| 4,407,310 | 10/1973 | Jadow | 132/73 |
| 4,626,428 | 12/1986 | Weisberg | 424/61 |
| 4,632,134 | 12/1986 | Reid | 132/73 |
| 4,646,765 | 3/1987 | Cooper et al. | 132/73 |
| 4,669,491 | 6/1987 | Weisberg | 132/73 |
| 4,818,520 | 4/1989 | Fleischner | 424/61 |

FOREIGN PATENT DOCUMENTS

| | | | |
|---|---|---|---|
| 1111934 | 5/1968 | United Kingdom | 424/61 |

*Primary Examiner*—John J. Wilson
*Assistant Examiner*—Adriene J. Lepiane
*Attorney, Agent, or Firm*—Irell & Manella

[57] ABSTRACT

An artificial fingernail material is disclosed. It contains base-treated bone powder of a particular particle size in a curable adhesive. A process for applying this material to the nail by applying an adhesive, adding bone powder and repeating as needed is disclosed as is the process for preparing the particular bone powder.

11 Claims, 1 Drawing Sheet

COMPOSITION AND METHOD FOR ENHANCING FINGERNAILS

DESCRIPTION

1. Technical Field

This invention is in the general fields of cosmetics and chemistry. More specifically, this invention relates to new compositions for strengthening and/or extending fingernails, a method for using said compositions, and a process for preparing the compositions of the invention.

2. Background

Since time immemorial, the human fingernail has been an object of beauty and a source of despair. In general, long fingernails are suitable for polishing and shaping into attractive forms. Often, fingernails are grown to extraordinary lengths as a personal decoration and symbol of status: wearing very long fingernails implies that the wearer need not perform manual labor, and may spend the time and resources necessary to maintain such impractical ornamentation.

Of course, very few can actually afford to dedicate their hands solely to beauty, yet many desire the luxury of long fingernails. Thus, long nails are subject to the stresses and hazards of normal use, and are frequently chipped or broken. Further, as fingernails grow relatively slowly, a great deal of time is consumed while the nails grow out. Thus, there exists a great need and desire for artificial means for lengthening and strengthening the fingernails. In order to convey the desired image of status, the artificial means must resemble natural nails as closely as possible —preferably they will be indistinguishable from natural fingernails—yet possess superior strength and durability. Artificial nails must accept polish and filing in the same manner as natural nails. Further, such artificial means should not be inconvenient or dangerous to wear or apply. For example, the artificial means should not cause the existing natural nail to crack or discolor, nor should such artificial means promote fungal growth beneath the nail. The materials used should not be unacceptably toxic, flammable, etc. Finally, keeping in mind that artificial nails are to be worn by those not having access to unlimited means, acceptable artificial nails must not be overly expensive.

A vast array of different solutions have been tried over the years, but the majority may be classified in one of two categories. The first category involves attaching a pre-formed imitation nail (fashioned from plastic or other materials) to the natural fingernail tip with an adhesive. In the second category, the fingernail is built up by repeated applications of a liquid or paste-like substance which, after drying, is filed and buffed smooth.

The first group ("pre-formed nails") is advantageous insofar as its limited effect on the natural nail and nailbed. As shown in FIG. 1 the artificial nail 6 is applied only to the fingernail tip 5 (i.e., the portion extending beyond the nailbed, the white portion of the natural fingernail), the adhesive is unlikely to pass through the nail to the nailbed 2, cuticle 4, or nail groove 3. This also leaves the nailbed free to breathe, so that fungal growth is not encouraged. However, there are several drawbacks. As a portion of the natural fingernail is exposed, the artificial nail must accept polish with an appearance identical to the natural nail: any difference is immediately noticeable. Thus, the selection of artificial nail materials is limited by surface characteristics. Additionally, the artificial nail must be of a strength and durability equal to or exceeding that of a natural nail, without requiring an obviously unnatural thickness. Further, the ultimate strength of the artificial nail depends upon the natural nail to which it is attached. The adhesive must be selected carefully to avoid causing the natural nail to curl or soften, yet bond the artificial nail firmly so that it is not dislodged easily. If the adhesive sets too quickly or too slowly, it may make proper alignment of the artificial nail difficult or impossible. Use of this method also presumes that there is a sufficient fingertip area to support the artificial nail.

The second group ("matrix nails") involves building the natural nail up by (often) repeated applications of a polymer or cement-like builder. Usually, a solid matrix of some type is applied with the builder to impart strength and rigidity, and to reduce the amount of builder required. Typically the matrix is a fabric, such as silk, linen, or paper. Other examples include fiberglass, graphite fibers (U.S. Pat. No. 4,646,765) and rayon fiber. Alternatively, one may use a powder matrix, such as powdered silica, polyester or glass. See e.g., U.S. Pat. Nos. 4,669,491; 4,626,428; and 4,407,310. These forms of artificial nails avoid the durability and matching problems inherent in pre-formed nails. However, they suffer from other difficulties. Since the nailbed is partially or completely covered, the overlying material must be such that the nailbed is not deprived of oxygen. Further, one must exercise greater care in selection of the builder, as discoloration and/or deformation of the nail overlying the nailbed takes considerably longer to grow out. Also, one must avoid building up a thick layer at the cuticle margin: otherwise, a "depressed" portion of nail will appear at the cuticle as the nail naturally grows out, leaving an obvious clue to the true nature of the artificial nail. FIGS. 2 and 3 illustrate this failing with matrix nails where nail 7 is as applied in FIG. 2 and as grown out in FIG. 3. Also, as the nail must fully dry before it can be shaped and polished, matrix nails may take considerably longer to apply, which is a distinct disadvantage. Finally, matrix nails must also accept normal polish and filing, so that they are not distinguishable from natural fingernails.

Additionally, artificial fingernails of either type may be incompatible with oils, creams, nail strengtheners, and other common nail care products. Further, it is frequently impossible to employ a water manicure immediately following nail application.

I have now invented a matrix composition for preparing artificial fingernails which is strong and durable, resembles natural fingernails closely, may be painted, polished, and filed in the same manner as natural fingernails, which does not exhibit deleterious effects when applied to natural fingernails, which may be applied to the fingernail tip or to the entire upper nail surface, and which may be applied in a very thin layer on the portion of the fingernail adjacent to the cuticle, thus minimizing any depression due to natural nail growth. The matrix nails of the invention further allow the nailbed to breathe, and permit nail strengtheners to penetrate. The matrix nails of the invention are also compatible with oils, creams, and may be subjected to water manicure shortly after application.

DISCLOSURE OF THE INVENTION

The instant invention provides a new matrix technique for lengthening and strengthening fingernails, a composition therefore, and a process for preparing the composition.

In the first aspect of the invention, a matrix composition for application to fingernails is provided, which matrix composition comprises base-treated powdered bone having a mesh size ranging from about 325 to about 230, preferably in combination with a cosmetically acceptable adhesive and in particular a cyanoacrylate B adhesive.

In another aspect of the invention, a process for preparing the matrix composition of the invention is provided, which process comprises providing bone pieces of approximately 3 inches in largest dimension, heating the bone pieces in an alkaline solution at elevated temperature, rinsing the treated bone pieces, drying the rinsed bone pieces at a temperature not exceeding about 125° C., grinding or milling the dried bone pieces to a fine powder, and screening said bone powder to eliminate particles larger than about 230 mesh and smaller than about 325 mesh.

In another aspect, a method is provided which comprises applying a suitable adhesive (preferably cyanoacrylate B glue) to the natural fingernail, and dipping the treated fingernail into the matrix composition of the invention. Optionally, these steps are repeated once to thrice (for a total of two to four applications); further, one may optionally apply a final coat of adhesive.

MODES OF CARRYING OUT THE INVENTION

A. Definitions

Figure 1:
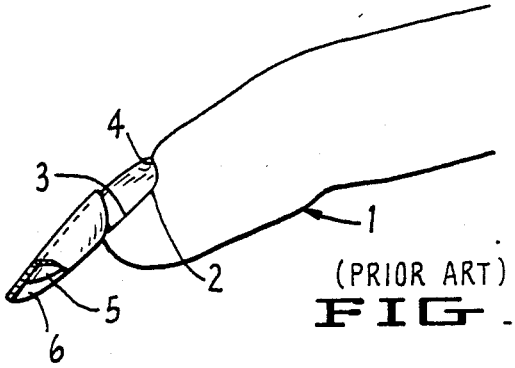
(PRIOR ART) FIG. 1.
FIG. 1 depicts in partial cutaway a finger 1 having a nailbed 2, a fingernail groove 3, a cuticle 4, a fingernail tip 5, and an artificial, preformed fingernail of the art attached thereto 6.
Figure 2:
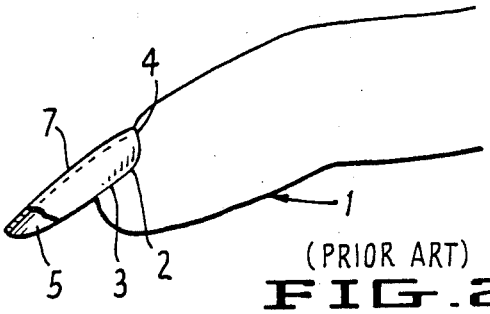
(PRIOR ART) FIG. 2.
FIG. 2 depicts in partial cutaway a finger 1 having a nailbed 2, a fingernail groove 3, a cuticle 4, a fingernail tip 5, and a conventional artificial fingernail matrix 7.
Figure 3:
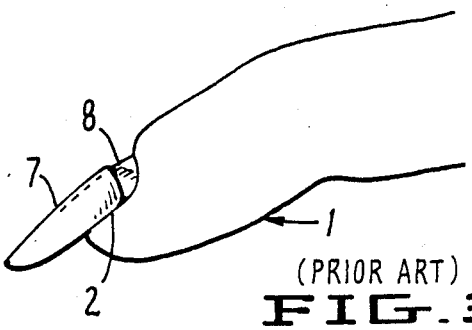
(PRIOR ART) FIG. 3
FIG. 3 depicts the finger 1 of FIG. 2 at an interval of time later (e.g., two weeks), exhibiting a depressed area 8 due to natural nail growth.

The term "base-treated" as applied to bone as used herein refers to treatment with a strongly alkaline solution at elevated temperature. Suitable bases in the practice of the invention include powdered lye, NaOH, KOH, and the like. They are used in solution, preferably aqueous solution, at a concentration between about 3% and about 25%, preferably about 10%.

Preferably, the bones are boiled in 10% lye for about 1 to 2 hours, the liquid drained off, and the bones boiled in fresh solution for an additional 1 to 2 hours. Preferably about 40 cups of solution is used for about 25 pounds of bones.

The term "cosmetically acceptable adhesive" as used herein refers to an adhesive capable of binding to human fingernail surfaces, which is water-insoluble, not unacceptably toxic, and which preferably exhibits no more than a minimal level of adverse effects (e.g., causing yellowing, curling, softness or brittleness of the underlying natural fingernail). A presently preferred class of adhesive is cyanoacrylate B, which are commercially available. Presently preferred cyanoacrylate B glues are Solar Seal TM (available from Creative Nail Design Inc., Oceanside, CA), and Finishing glue (available from Never Lift Nail Tips, West Covina, CA). Other possible adhesives for use herein include urethane adhesives, empty rim adhesives, acrylic adhesives and other low temperature cure adhesives. Conventional nail enamels and lacquers are also bonded to the nail and provide a continuous phase for the matrix. However, these latter materials are less durable and generally not preferred.

These materials are all well known and commercially available. They are further described in the literature such as in the section "Adhesive" appearing at page 122–123 of Volume 1 of McGraw-Hill Encyclopedia of Science and Technology.

These adhesives in some cases can be applied as a single component (this works with the cyanoacrylates, for example) or in some cases (epoxy monomer and peroxide catalyst, for example) are mixed just prior to use.

B. General Method

The matrix composition of the invention is prepared generally as follows:

Bones pieces, preferably beef shanks, are first chopped into rough pieces approximately 3 inches across. (The joints are preferably avoided.) These pieces are then heated in an alkaline solution at elevated temperature, preferably 10% aqueous lye at about 100° C., for about 1 to 5 hours, preferably about 2 hours. Preferably, the alkaline solution is then drained and replaced, and the bone pieces boiled for an additional 1–2 hours. About 40 cups of solution (X2) is sufficient to treat about 25 pounds of bone pieces.

The alkaline-treated bone pieces are then rinsed with water, preferably after first boiling the alkaline-treated pieces in neutral water for about 1 to 2 hours.

The rinsed bone pieces are then dried at temperatures not exceeding about 125° C. It is preferred to dry the bone pieces slowly, at about 40–90° C., in order to prevent yellowing. The bone may be dried under vacuum or reduced pressure, if desired.

The dried bone pieces are then reduced to a fine powder, for example by grinding or jaw crushing followed by ball-milling. The resulting powder is then sized, for example by screening, to remove particles that are excessively large or small. The preferred particle size distribution passes through a 230 mesh screen, but not a 325 mesh screen. I have found that bone particles larger than 230 mesh, or smaller than 325 mesh, do not form a suitable, durable artificial fingernail. If the particle size exceeds about 230 mesh, the fingernail formed tends to be crumbly, and lacks sufficient strength to survive the vicissitudes of normal use. If the particle size is smaller than about 325 mesh, the resulting powder does not provide enough bulk to form an effective matrix. With the preferred particle sizes a natural appearing nail is achieved, while with larger particles a granular appearance obtains, and with all smaller particles a chalky appearance results. Thus, the preferred particle size ranges from about 0.0017 inches to about 0.0025 inches.

Figure 4:
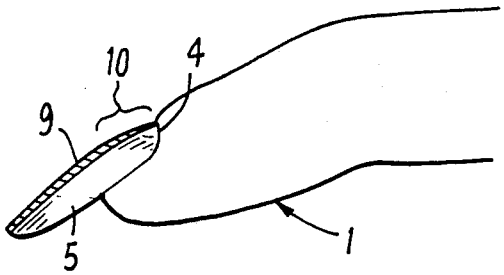
FIG. 4 depicts a cross-section of finger 1 having an artificial nail matrix of the invention 9, illustrating the tapering matrix 10 in the direction of the cuticle 4.

The matrix may be used in the following method:

a cosmetically acceptable adhesive, preferably a fast-setting cyanoacrylate B, is applied to the upper surface of the natural fingernail 2, preferably over the entire surface to the cuticle 4. (Caution should be exercised to avoid applying glue to the cuticle itself.) This application can be over the fingernail tip or it can be over the entire nail surface (i.e., tip and area over the nail head). The adhesive is typically applied with a supplied applicator, but may be sprayed on if a mask is used to shield the finger and cuticle. The finger 1 is then immediately immersed in the powdered bone matrix of the invention, removed, and excess powder tapped off. Then, a second layer of cyanoacrylate adhesive is applied. The finger is again immersed in the powdered bone matrix, removed, and the excess tapped off. This step is repeated at least one more time, and the nail sealed with an additional application of cyanoacrylate. This sealant adhesive is preferably a thin, low-viscosity cyanoacrylate B. The resulting nail is then filed and shaped to the desired form, buffed to smoothness, an additional sealant layer applied, buffed, and polished and/or painted. This results in a final product as shown in FIG. 4 wherein finger 1 with nail 5 is equipped with artificial nail 9. This nail is tapered toward its cuticle 4 as shown by region 10. With repeated applications and renewals the contour is maintained throughout the wearing period.

The matrix may also be used to fill in breaks, or to fill in gaps, e.g., between a preformed nail tip or wrap and the natural nail. In general practice, the gaps appearing at the cuticle edge of the nail are filled in after 3–7 weeks, typically 4–6 weeks (in contrast to the 1–2 weeks necessitated by prior art matrix compositions). The matrix may additionally be applied to the underside of the nail, if desired.

C. Examples

C.1 Preparation of Powdered Bone Matrix

Twenty-Five pounds of beef shank bones were broken into approximately 3" pieces, and placed in a large pot. The bone pieces were covered with about 40 cups of water and 4 cups of dry lye. The mixture was heated to a boil, and was boiled for about two hours. Then, the liquid was drained and another 40 cups of water and 4 cups of lye added, and the fresh mixture boiled for an additional two hours.

The lye solution was again discarded, and replaced with 40 cups of fresh water. The bone pieces were boiled for about two hours, then rinsed in cool water.

The rinsed bone pieces were then dried in air in a drying oven at about 80° C. until the pieces were white and chalky. The dried bone pieces were then ball-milled to a powder, and screened to provide a fraction sized between 230 and 325 mesh.

C.2 Application of Matrix

A subject's fingernails were trimmed and lightly buffed to remove natural oils, to prepare the nails for application. Then, proceeding one fingernail at a time, a coat of Solar Seal TM cyanoacrylate B adhesive was applied over the entire upper surface of the nail, taking care to avoid the cuticle 10. The finger was then immediately plunged into a container of bone matrix powder as prepared above, removed, and the finger tapped on the table to shake off excess powder. A second coat of adhesive was then applied, the finger inserted in the powder, and an additional coat of adhesive and powder applied in like fashion. A final, fourth coat of Finishing glue (Never Lift Nail Tips, West Covina, CA) adhesive was applied to seal the nail.

The artificial nail was then shaped and smoothed by filing, buffed, a second layer of sealant applied, buffed, and polished with conventional fingernail polish. The above procedure was applied to each of the fingers. One may optionally treat the cuticles with a suitable oil and/or cream without damaging the matrix nails. One may also advantageously apply a penetrating nail strengthener (prior to polishing), for example Living Nail (available from Arizona Natural Resources Inc., Phoenix, AZ) without damage to the matrix nails.

An additional "touch up" coat of top coat and clear nail enamel (e.g., Develop 10, from Vital Nail, New York) was applied every 48 hours to maintain the nail.

The artificial fingernails thus prepared demonstrated superior longevity and more aesthetic appearance than conventional artificial fingernails. Further, it was observed that the matrix nails of the invention could be worn for at least four weeks without requiring "touching up."

C.3 Comparative Test

A fingernail of the invention is prepared on the index fingers of a subject, as in Example C.2 above. On the middle finger of one hand, a conventional matrix-type fingernail 7 is applied, and a pre-formed nail 6 applied to the ring finger. On the other hand, a matrix is prepared as in Example C.1 above on the middle finger, but substituting a powdered bone fraction larger than 230 mesh for the preferred powder fraction. On the ring finger, another matrix is prepared as in Example C.1, but substituting a powdered bone fraction smaller than 325 mesh for the preferred powder fraction. All fingernails are polished, and otherwise treated normally. The little fingers on each hand serve as controls: the left little finger serves as a painted control, while the right little finger is used as the unpainted (untreated) control.

The fingernails are observed daily for two weeks for natural appearance, presence of chips or cracks, flexibility, lifting, and perceptible discontinuities from the natural nail. The results indicate that the matrix fingernails of the invention exhibit superior natural appearance when polished, are more durable, do not cause the underlying natural nail to yellow, and (when polished) generally appear to be natural nails in all aspects. After two weeks, the conventional matrix nail 7 exhibits a marked depression 8 between the nail edge and the cuticle 4, whereas the nails of the invention exhibit little or no depression.

The procedure above is repeated, using a variety of different nail polishes, and varying the particular fingers used.

I claim:

1. A dry powder product suitable for application to a layer of cosmetically acceptable adhesive for strengthening or extending fingernails, which powder product comprises:

base-treated, dried, powdered bone, having a particle size between about 230 mesh and about 325 mesh.

2. An artificial fingernail matrix composition, which composition comprises:

particles of base-treated, dried, powdered bone, having a particle size between about 230 mesh and about 325 mesh dispersed throughout, imbedded in a layer of a cosmetically acceptable adhesive.

3. The composition of claim 2 wherein said adhesive is a cyanoacrylate B adhesive.

4. A process for preparing a bone matrix composition for use in artificial fingernails, which process comprises:

heating bones in an alkaline aqueous solution;

rinsing said alkaline-treated bones;

drying said rinsed bones at a temperature not exceeding 125° C.;

reducing said dried bones to a fine powder; and removing bone particles larger than about 230 mesh and particles smaller than about 325 mesh.

5. The process of claim 4 wherein said alkaline aqueous solution comprises 10% aqueous lye, NaOH or KOH.

6. The process of claim 5 wherein said bones are heated in said alkaline aqueous solution at about 100° C. for about 1 to 5 hours.

7. The process of claim 6 wherein the alkaline treatment step is repeated at least once.

8. The process of claim 5 wherein said alkaline-treated bones are heated in water at about 100° C. for about 1 to 5 hours, prior to rinsing with water.

9. A method for preparing an artificial fingernail on a subject's natural fingernail, which method comprises the sequential steps of:

applying a first layer of cosmetically acceptable adhesive to the upper surface of a subject's natural fingernail;

applying base-treated, dried, powdered bone, having a particle size between about 230 mesh and about 325 mesh to the first layer of adhesive so as to form a layer of powdered bone particles adhered to the first layer of adhesive; and applying a second layer of cosmetically acceptable adhesive over the layer of powdered bone particles.

10. The method of claim 9 which further comprises:

applying a second layer of the base-treated, dried, powdered bone particles having a particulate size between about 230 mesh and about 325 mesh; and applying a third layer of cosmetically acceptable adhesive over the second layer of powdered bone particles.

11. The method of claim 10 which further comprises:

applying a third layer of the base-treated, dried, powdered bone particles having a particulate size between about 230 mesh and about 325 mesh; and applying a fourth layer of cosmetically acceptable adhesive over the third layer of powdered bone particles.

* * * * *